US008740669B2

(12) United States Patent
McFadden et al.

(10) Patent No.: US 8,740,669 B2
(45) Date of Patent: Jun. 3, 2014

(54) DAMAGE PREVENTION TOOL AND METHOD

(75) Inventors: Theodore J. McFadden, Huntington Beach, CA (US); Cameron L. DeMille, Cathedral City, CA (US); Larry L. Livingston, Jr., Pilot Hill, CA (US)

(73) Assignee: Omni Cubed, Inc., Placerville, CA (US)

( * ) Notice: Subject to any disclaimer, the term of this patent is extended or adjusted under 35 U.S.C. 154(b) by 241 days.

(21) Appl. No.: 13/526,731

(22) Filed: Jun. 19, 2012

(65) Prior Publication Data

US 2013/0029562 A1 Jan. 31, 2013

Related U.S. Application Data

(60) Provisional application No. 61/574,104, filed on Jul. 28, 2011.

(51) Int. Cl.
*B24B 1/00* (2006.01)

(52) U.S. Cl.
USPC ..... 451/28; 451/359; 451/549; 451/353

(58) Field of Classification Search
CPC ..... B24B 23/02; B24B 23/028; B24B 41/04; B24B 41/042; B24B 55/052; B24B 3/36; B24B 3/46; B24D 15/08; B24D 15/082
USPC ..... 451/344, 359, 545, 549, 349, 353, 28
See application file for complete search history.

(56) References Cited

U.S. PATENT DOCUMENTS

| | | | | | |
|---|---|---|---|---|---|
| 2,432,753 | A * | 12/1947 | McMurtry | 409/181 |
| 2,508,967 | A * | 5/1950 | O'Rielly | 451/549 |
| 2,993,312 | A * | 7/1961 | Holland et al. | 451/549 |
| 3,583,017 | A * | 6/1971 | Davis | 15/98 |
| 3,803,771 | A * | 4/1974 | Bunn | 451/359 |
| 3,935,678 | A * | 2/1976 | Marton | 451/359 |
| 5,031,363 | A * | 7/1991 | Thiem | 451/63 |
| 5,394,652 | A * | 3/1995 | Casillas et al. | 451/241 |
| 6,315,647 | B1 * | 11/2001 | Ghilardi | 451/75 |
| 6,363,817 | B1 * | 4/2002 | Lamond et al. | 81/22 |
| 6,659,852 | B1 * | 12/2003 | Wettstein et al. | 451/557 |
| 7,134,949 | B2 * | 11/2006 | Nomoto et al. | 451/358 |
| 7,153,199 | B1 * | 12/2006 | Decker | 451/343 |
| 7,654,886 | B2 * | 2/2010 | Chang | 451/359 |
| 2003/0226225 | A1 * | 12/2003 | Graceffo | 15/98 |
| 2007/0072524 | A1 * | 3/2007 | Wettstein et al. | 451/354 |
| 2011/0171892 | A1 * | 7/2011 | Wettstein et al. | 451/548 |

FOREIGN PATENT DOCUMENTS

GB 2198975 * 6/1986 ..... B24C 5/02

* cited by examiner

*Primary Examiner* — George Nguyen
(74) *Attorney, Agent, or Firm* — Manuel de la Cerra

(57) ABSTRACT

A damage prevention tool and method is provided in which a free-floating disk is connected to an abrasion disk through a bearing structure. When the tool is actuated, the abrasion disk rotates substantially independent of the floating disk. The floating disk may have a slightly larger circumference and a non-marring friction material on its outer edge, such that the outer edge does not damage foreign objects and protects the abrasion disk, and the abrasion material mounted to the abrasion disk, from contacting foreign objects.

15 Claims, 7 Drawing Sheets

Along A-A

Along A-A

Along A-A

DAMAGE PREVENTION TOOL AND METHOD

1.0 CROSS-REFERENCE TO RELATED APPLICATIONS

This application claims priority as a non-provisional of U.S. Patent Application No. 61/574,104 entitled THE TOOL filed on Jul. 28, 2011 filed by Cameron L. DeMille and Therodore J. McFadden. This patent application is incorporated herein in its entirety.

2.0 FIELD OF THE INVENTION

This invention relates to power polishers. More particularly, this invention relates to tools that use abrasive surfaces to finish surfaces by means of abrasion such as polishing, sanding, buffing, etc.

3.0 BACKGROUND

Abrasion tools are often used for polishing, sanding, buffing, or refinishing surfaces such as countertops and floors constructed of tile, concrete, terrazzo, stone, wood, etc. A user generally uses an abrasion pad or disk connected to a power tool (power polisher, power polisher, power drill, etc.), actuates the power tool thus causing the abrasion disk to rotate at a high rotational velocity. The user then glides the abrasion disk over the plane of the surface to be polished or roughened, such that the abrasion disk grinds off a small amount of the surface material. This may be accomplished with an abrasion disk alone, or in combination with an abrasive compound.

When using a power tool for surface finishing, the edge of the rotating abrasion disk may unintentionally "bite" into the adjacent vertical surfaces such as backsplashes, walls, cabinets, faucet fixtures, etc., causing damage to the vertical surface and may result in costly and time consuming repairs. Also, the tool may "jump" or become momentarily unbalanced when the rotating abrasion disk contacts a vertical surface, and this can adversely affect the quality of the surface finish. To avoid this, users can use utmost care and slow down the polishing processes so as to be careful to avoid marring or damaging the adjacent vertical surface. This is not a very effective solution because it wastes time, causes user muscle strain, and because the power tools rotate at such a high velocity, it can be unwieldy and contact vertical surfaces despite the user's best efforts to the contrary.

Thus, users universally mask these areas prior to polishing, and use care when approaching vertical surfaces with the power tool. This, too, however, has its drawbacks. First, masking takes significant time, and the masking material can nevertheless be ineffective if the abrasion disk takes a significant "bite" into and through the protective material down to the vertical surface. Second, the user still must use utmost care when approaching masked vertical surfaces with the power tool in order to create a uniform finish that is consistently close to the vertical surfaces. Third, masking still does not solve surface finish issues associated with the tool "jumping" or becoming unbalanced when the abrasion disk contacts a masked vertical surface, because masking is only intended to protect the surface being masked. Finally, even when surfaces are masked, the user must still be more precise in order to avoid making contact with the masked vertical surfaces, thus wasting time.

Therefore, what is needed is a device that protects surfaces that jut away from the polished surface, such that masking and other methods preparation and precautions are eliminated or reduced.

4.0 SUMMARY

Provided is a damage prevention tool that is used as an attachment to a power polisher. The tool comprises an abrasion disk, a floating disk, and a bearing structure. The abrasion disk comprises an axle that is connected to the power polisher and a surface on which an abrasion material may be mounted. The floating disk contains an opening that the axle can be placed through. The floating disk further comprises a bearing structure that is constructed to allow the floating disk to rotate about the axle. The bearing structure allows the floating disk to rotate substantially independent of the abrasion disk.

The floating disk may have a non-marring friction material disposed on the outer edge, or optionally the floating disk can be constructed of a non-marring friction material. Also, the circumference of the floating disk may be greater than the circumference of the abrasion disk.

In operation, the rotation of the axle causes some rotation of the floating disk. This is because the bearing structure is in contact with both the axle and the floating disk, and, thus, it imparts friction force between the floating disk and the axle.

The non-marring friction material is adapted to come into contact with a vertical surface or a foreign object during operation. When the non-marring friction material contacts a vertical surface or foreign object, it imparts a second friction force between the floating disk and the surface it contacts. This contact causes the floating disk to stop rotating because the second friction force is greater than the first friction force (i.e., the force between the floating disk and the axle).

To use the tool herein, the tool must be connected to a power polisher. Actuating the power polisher then causes the abrasion disk to rotate. The abrasion surface of abrasion material is then placed in contact with the surface to be finished (finishing surface). The abrasion surface is a level surface that is abrasive. The tool is then moved substantially parallel to the finishing surface, which begins the process of finishing the surface. While moving the tool to finish the surface, the user may position the tool so that the non-marring friction material makes contact with a vertical surface or foreign object that juts away from the finishing surface. When the non-marring friction material contacts the vertical surface or foreign object, the floating disk stops rotating in relation to the abrasion disk.

The tool can travel along about the surface of the jutted foreign object or vertical surface while the floating disk stays in substantial contact with the surface of the foreign object. Thus, the abrasion disk can continue to finish the surface and get very close to the vertical surface or foreign object, while the tool is pushed against and moved about the vertical surface or foreign object.

5.0 BRIEF DESCRIPTION OF THE DRAWINGS

The details of the present invention, both as to its structure and operation, may be gleaned in part by study of the accompanying drawings, in which like reference numerals refer to like parts, and in which.

6.0 DETAILED DESCRIPTION

Figure 1A:
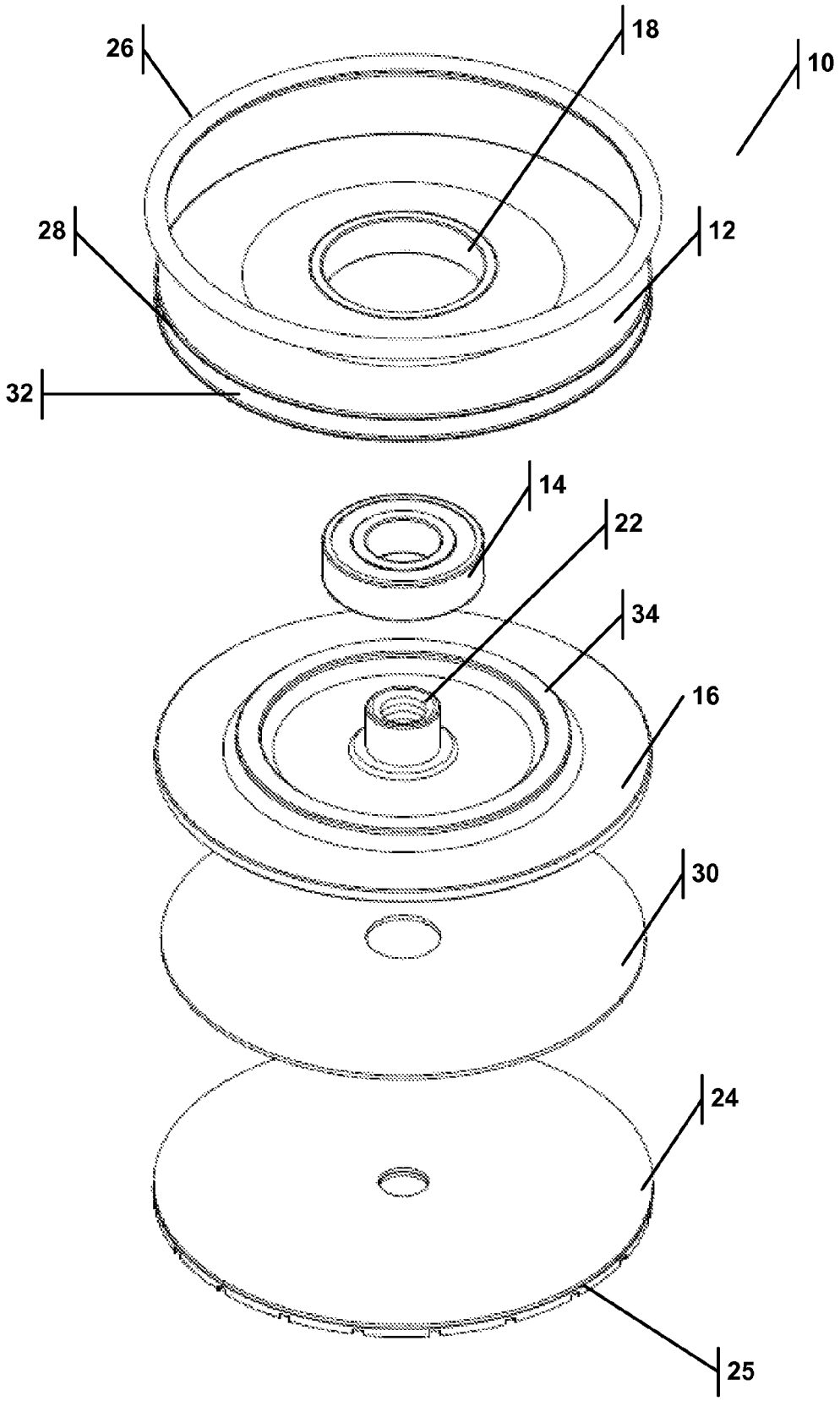
FIG. 1A is an exploded view of the novel tool.
Figure 1B:
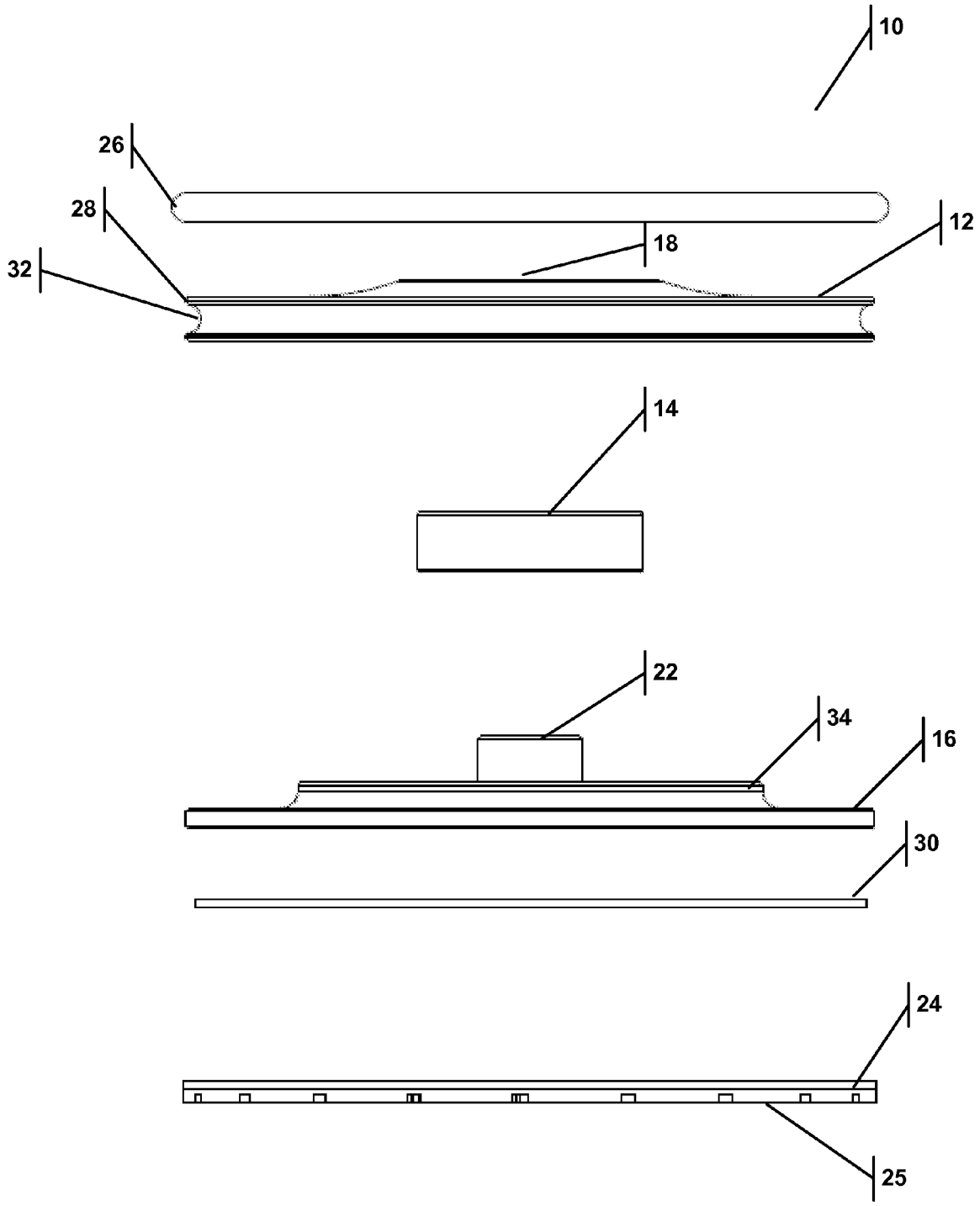
FIG. 1B is an exploded view of the novel tool.

Following is a non-limiting written description of example embodiments illustrating various aspects of the invention. These examples are provided to enable a person of ordinary skill in the art to practice the full scope of the invention without having to engage in an undue amount of experimentation. As may be apparent to persons skilled in the art, further modifications and adaptations can be made without departing from the spirit and scope of the invention, which is limited only by the claims.

What is provided herein is a tool that includes a free-floating disk connected to an abrasion disk through a bearing structure, such that the abrasion disk and the floating disk rotate substantially independent of each other. The floating disk may optionally have a non-marring friction material about its outside edge and may have a slightly larger circumference than the abrasion disk, such that the outer edge of the abrasion disk will not make contact with, or "bite" into, vertical surfaces and foreign objects. Alternatively, the floating disk itself may be made of a non-marring friction material.

FIGS. 1A-1D illustrate an example embodiment of a damage prevention tool attachment 10 to a power polisher, which comprises an abrasion disk 16, a floating disk 12, and a bearing structure 14. While power polishers are often used by those in the art, this term is used herein generically to refer to a power tool with an axle connected to an electric motor. Also the bearing structure 14 may be constructed of a low friction material commonly used in sleeve bearing structures such as plastic (PTFE, UHMW, PET, nylon, etc.), and can be an integrated structure in the abrasion disk 16, the axle 22 and the floating disk 12. Alternatively, or additionally, the bearing structure 14 may comprise rolling-element bearings (which may include, but are not limited to, ball bearings or needle bearings) or a plain sleeve bearing. From these non-limiting examples, it would be apparent to those skilled in the art that any variety of materials and structure may be used to construct the bearing structure and provide the needed reduction in friction between the abrasion disk and the floating disk.

The abrasion disk 16 comprises an axle 22 and a surface on which an abrasion material 24 may be mounted. By way of example, the abrasion disk 16 may be attached to a power polisher. The abrasion material 24 that is mounted on the abrasion disk 16 may be of material used for tasks such as polishing, sanding, buffing, etc. The abrasion material 24 can be mounted to the abrasion disk 16 by means that include but are not limited to a locking disk, hook and loop fasteners, Velcro, tape, and adhesives generally. Such a structure is shown at part number 30. The abrasion material 24 contains an abrasion surface 25 that actually contacts the surface to be finished (i.e., the finishing surface). The abrasion disk 16 is connected to a power polisher at the axle 22.

The floating disk 12 contains an opening 18 through its center. The axle 22 is disposed of in the opening 18 through the floating disk 12. This allows the floating disk 12 to be positioned between the abrasion disk 16 and a power polisher when the abrasion disk 12 is connected.

The floating disk 12 further comprises a bearing structure 14 constructed to allow the floating disk 12 to rotate about the axle 22 substantially independent of the abrasion disk 16. As illustrated in the embodiment in FIG. 1, by way of example, the bearing 14 is placed in the opening 18 of the floating disk 12 and is free-floating, such that the exterior circumference of the bearing structure 14 fits within the opening 18 of the floating disk 12. The axle 22 is then placed through the opening in the bearing structure 14 and connected to a power polisher, such that the floating disk 12 and the bearing structure 14 are positioned between the abrasion disk 16 and a power polisher. The bearing structure 14 imparts a first friction force between the floating disk 12 and the abrasion disk 16 such that rotation of the axle 22 during operation may cause some rotation of floating disk 16.

The floating disk 12 further comprises an outer edge 28, wherein the circumference of the outer edge 28 of the floating disk 12 may be greater than the circumference of the abrasion disk 16, and the abrasion disk 12 contains a non-marring friction material 26 disposed on the outer edge 28 of the floating disk 12. In the embodiment shown, the non-marring friction material is a rubber ring and fits into a groove 32 that circumscribes the floating disk on the outer edge 28. While the term "non-marring" is used herein, it will be understood that the material may still cause a mark but would cause much less damage than the "bite" caused by the abrasion disk 16. Alternatively, the floating disk 12 itself may be made of a non-marring friction material, thus negating the need for a separate non-marring friction material structure.

The floating disk 12 optionally having a greater circumference with the non-marring friction material allows the floating disk 12 to come into contact with a foreign object before the abrasion disk 16 can bite into the foreign object, which would cause damage. Foreign objects include walls and other surfaces or objects that are not meant to come into contact with the abrasion disk 16 during operation. The non-marring friction material 26, therefore, protects the foreign object from the damage that could be caused from being run into by a hard abrasion disk rotating at a high velocity.

The abrasion disk 16 may also optionally have a raised rib 34. This rib 34 may serve two functions: It allows the abrasion disk 16 to be thinner (so the tool is lower profile), yet still be rigid and avoid flexing during operation. Second, as shown in FIG. 1D, rib 34 also prevents debris and cooling water from entering the area near the bottom of the bearing structure 14 (shown in FIG. 1D as arrow 36), thus prolonging the life of the tool.

Figure 1C:
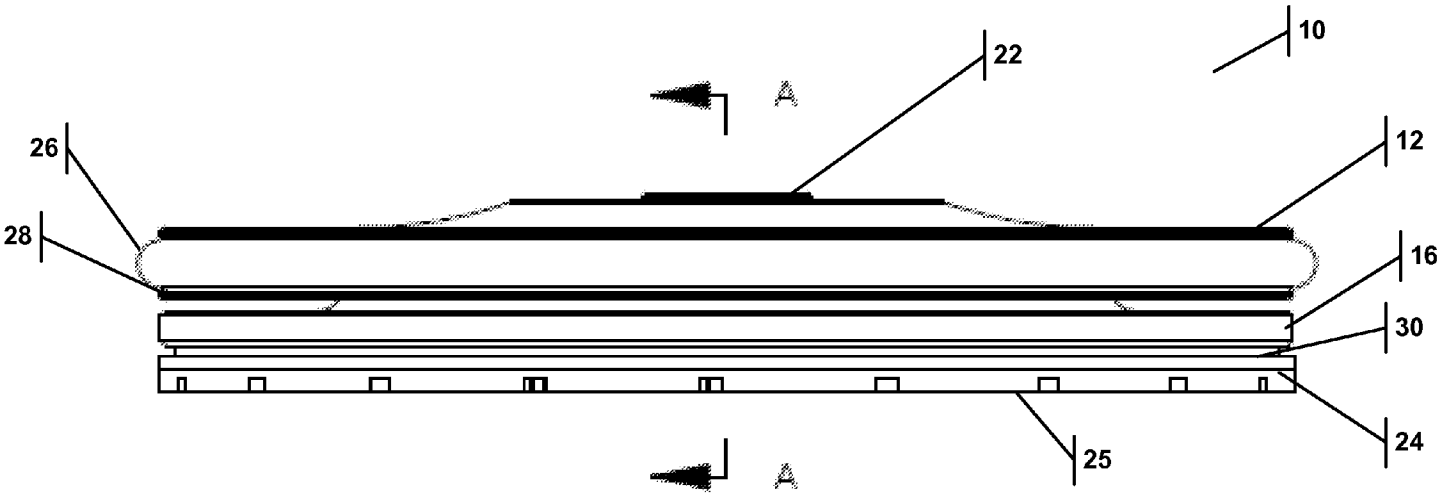
FIG. 1C is a side view of the novel tool assembled.
Figure 1D:
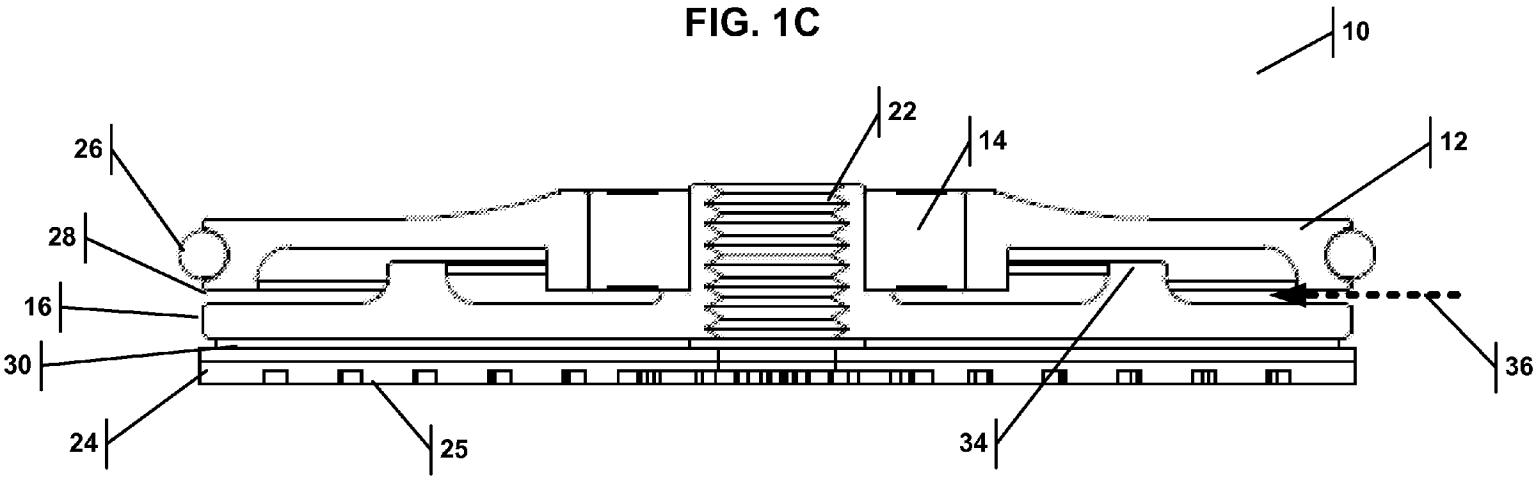
FIG. 1D is a cross-sectional view along line A-A of FIG. 1C of the novel tool assembled.

FIGS. 1C and 1D illustrate all the parts of the tool 10 assembled. In a preferred embodiment, the assembly may be completed by pressing all the parts in an industrial press. In another embodiment, high performance adhesives may be used to join the parts. And in another embodiment the various pieces a fit together with no need for pressing or adhesion.

The non-marring friction material 26 may also stop the floating disk 12 from rotating while in contact with the foreign object, which protects the foreign object from the floating disk 12 continuing to spin during contact. When non-marring friction material 26 comes into contact with the foreign object during operation, this contact imparts a friction force between the floating disk 12 and the foreign object. This second friction force is greater than the first friction force (i.e., the force between the floating disk 12 and the axle 22 of the abrasion disk 16) such that the floating disk 12 will stop rotating. This allows the outer edge 28 of the floating disk 12 to essentially roll over (or across) the foreign object while the user moves the tool in the desired direction.

Figure 2A:
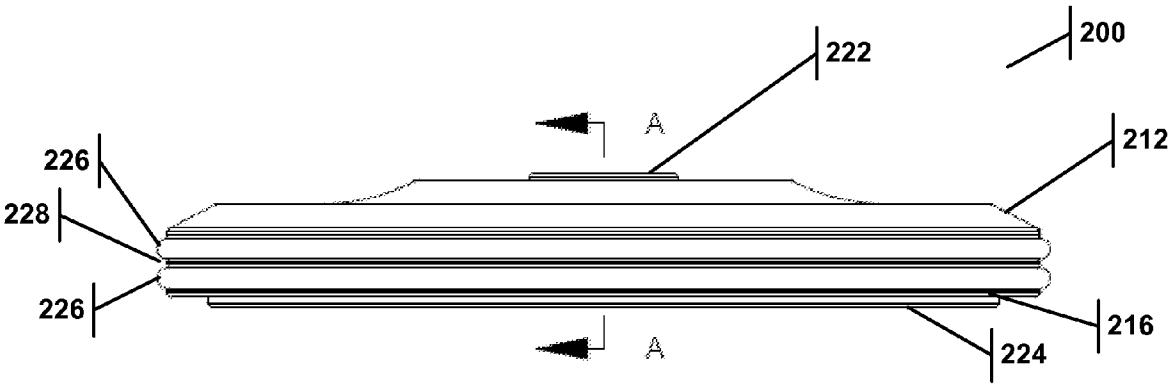
FIG. 2A is a side view of an alternate embodiment of a novel tool assembled.
Figure 2C:
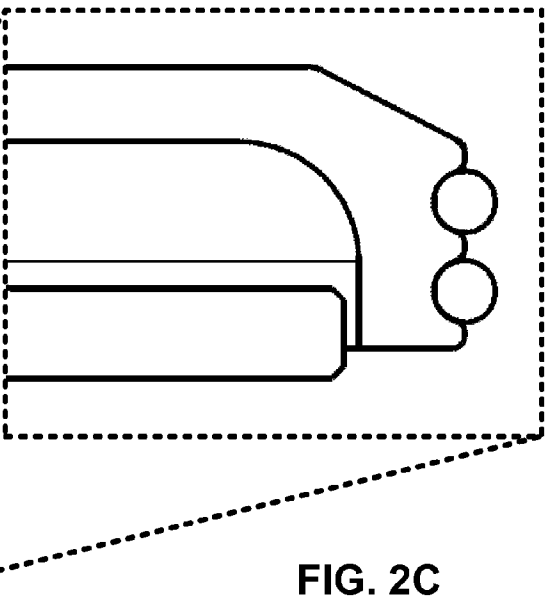
FIG. 2C is an enlarged view of a portion of the alternate embodiment of a novel tool assembled.
Figure 2B:
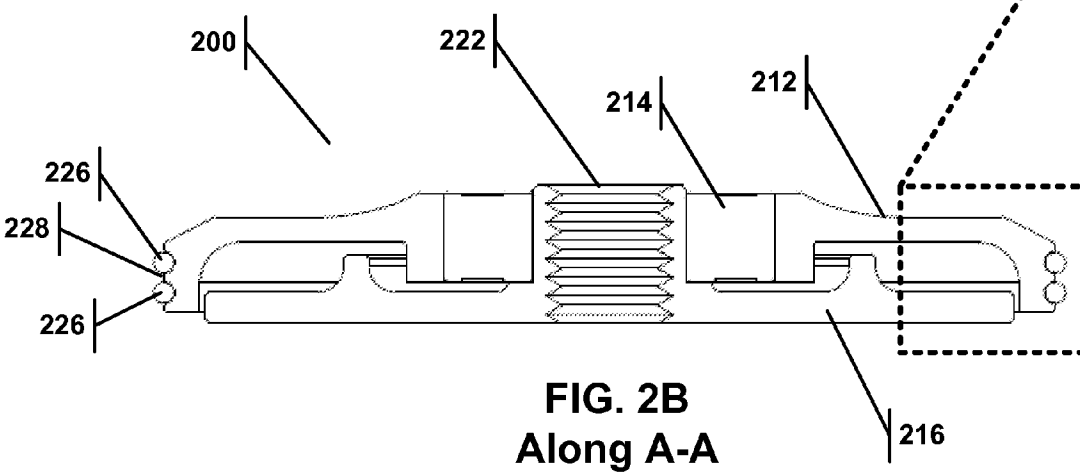
FIG. 2B is a cross-sectional view along line A-A of FIG. 2A of the alternate embodiment of a novel tool assembled.

Shown in FIG. 2A-2C is an alternate embodiment where the floating disk at least partially circumscribes the abrasion disk. Specifically, tool 200 has a floating disk 212 and an abrasion disk 216 onto which abrasion material 224 may be mounted. The outer edge 228 of the floating disk 212 may optionally have a non-marring friction material 226 (or as shown in FIG. 2A two bands of such a material). Alternatively the entire floating disk 212 may be comprised of a non-marring friction material. The cross section view in FIG. 2B illustrates the at least partial circumscription of the abrasion disk 216 by the floating disk 212, where the floating disk can rotate independently of the abrasion disk 216 by virtue of the bearing structure 214. The floating disk 212 has a larger diameter than the abrasion disk 216, and actually forms a bowl into which the abrasion disk 216 fits. This is shown in an enlarged view in FIG. 2C.

6.1 How to use the Tool

Figure 3:
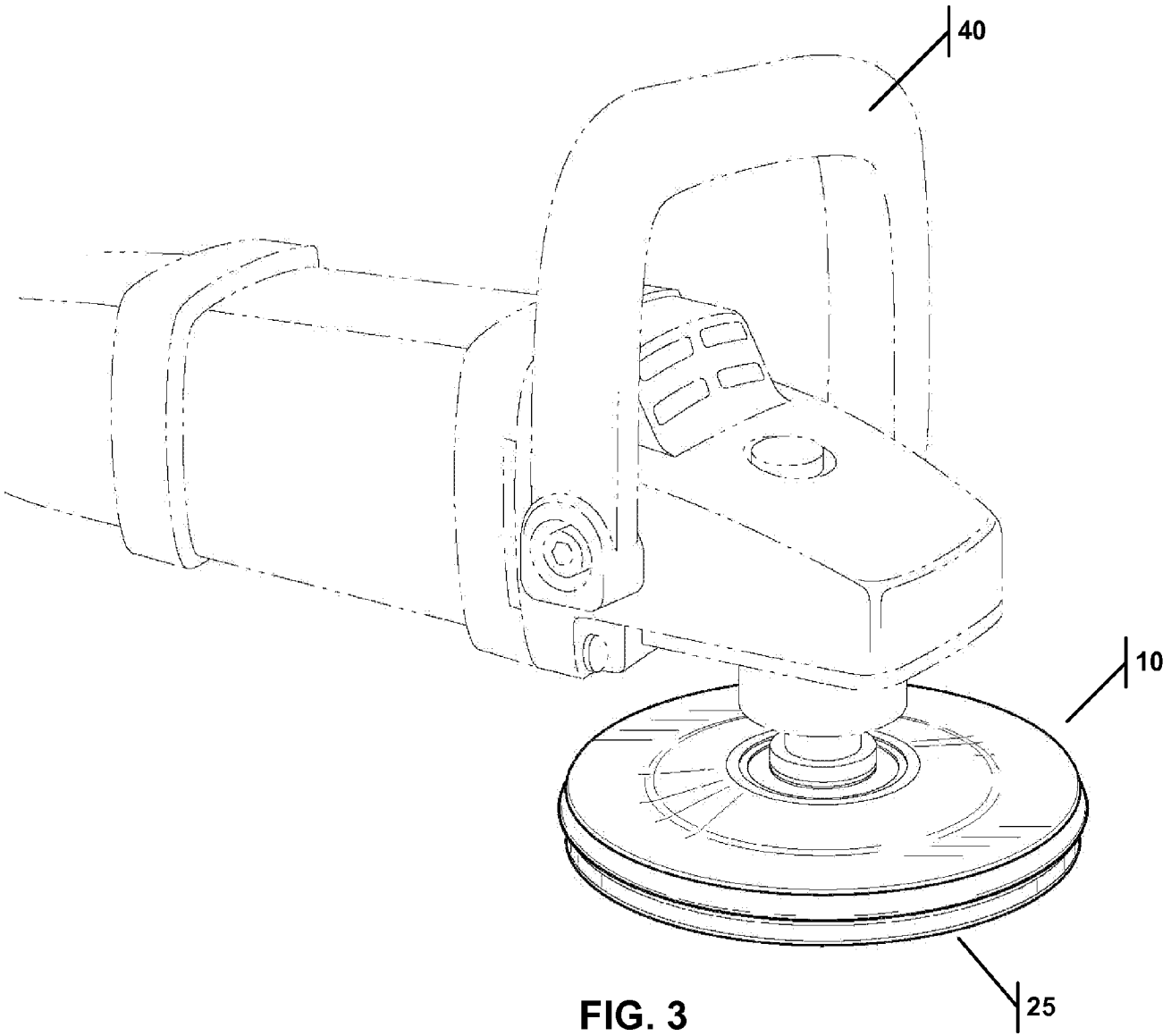
FIG. 3 illustrates the tool installed on a power polisher.
Figure 4A:
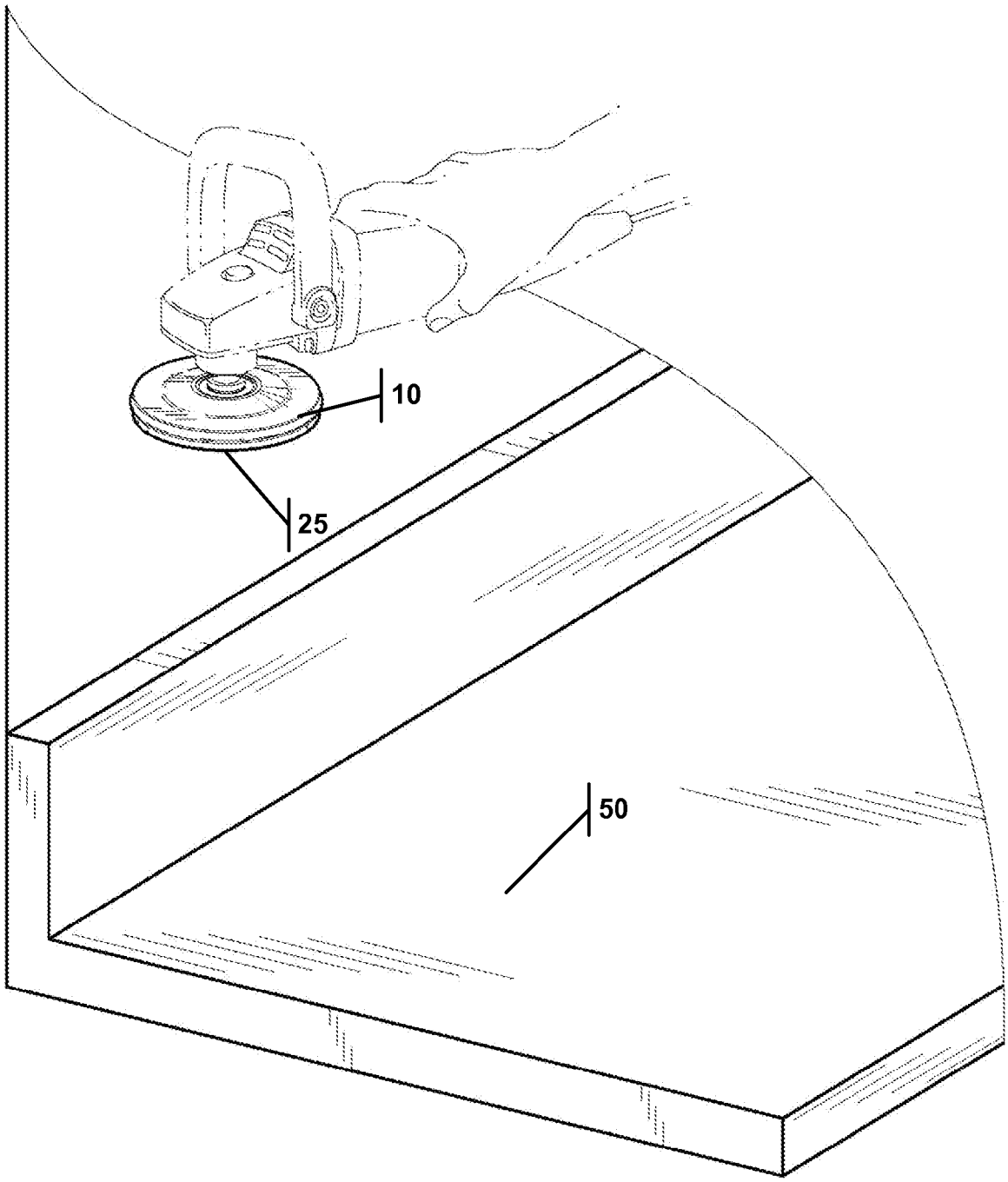
FIGS. 4A-4C illustrate a method of using the novel tool.
Figure 4B:
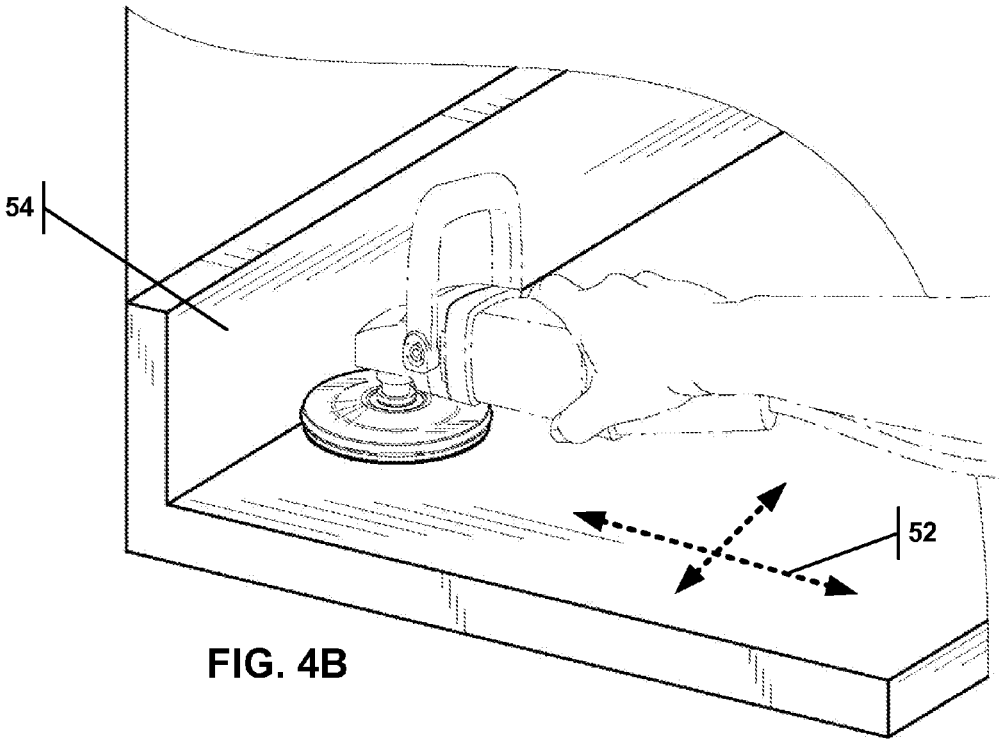
Figure 4C:
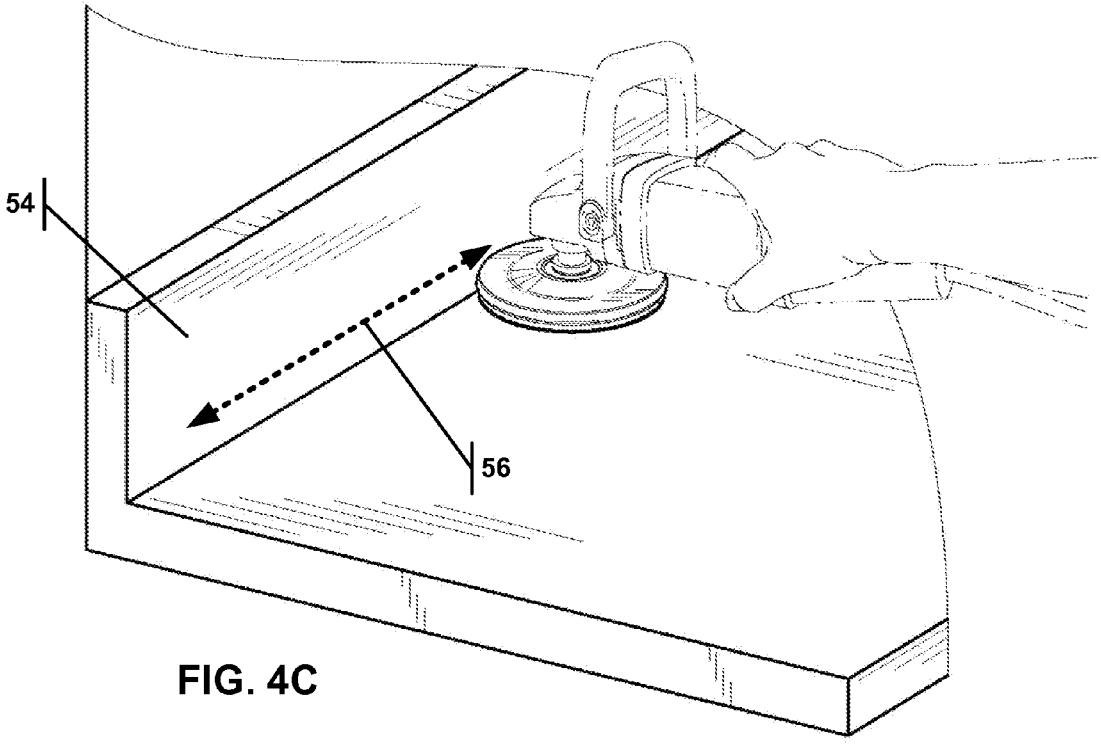

With reference to FIGS. 3-4C, a method of using the novel tool will now be described. During use of the tool 10 described herein, the user first connects the tool to a power polisher and actuates the power polisher, which in turn, causes the abrasion surface 25 to rotate. Connection of the tool 10 to the power polisher 40 through the axle is shown in FIG. 3.

FIG. 4A shows the tool 10 immediately above a finishing surface 50. The user then places the abrasion surface 25 of the tool in contact with a finishing surface 50 as shown in FIG. 4B. The abrasion surface 25 of the abrasion material 24 has a level surface, such that when the abrasion surface 25 contacts a level surface to be polished (the finishing surface), the surface of the abrasion material 25 is in contact with the finishing surface. The finishing surface is the area that the damage prevention tool 10 is used on to perform tasks such as polishing, sanding, buffing, etc. The finishing surface includes surfaces such as countertop, tile, and stone.

After placing the abrasion surface 25 in contact with the finishing surface, moving the tool substantially parallel to the finishing surface (shown by arrows 52) will cause the abrasion material 24 to finish the finishing surface. To finish the finishing surface is to remove small amounts of material from the finishing surface, whether to make smoother or to make rougher, using the abrasion material 24. For example, to finish a countertop the abrasion material 24 is usually used to make the countertop smoother and polished. The user may optionally use an abrasive compound in conjunction with the tool 10.

When the tool contacts a foreign object that juts away from the finishing surface, such as a backsplash 54, the non-marring friction material 26 on the floating disk 12 contacts the foreign object. This prevents the abrasion disk 16, and the abrasion material 24 mounted to the abrasion disk 16, from contacting the foreign object and causing damage. Moreover, the abrasion disk 16 will continue rotating at its same speed, and therefore is not slowed and can continue to effectively finish the finishing surface. The abrasive disk 16 can, therefore, get very close to the foreign object without causing damage, which requires less time lost to precision, thus allowing the user to complete the project more quickly and efficiently.

The non-marring friction material 26 also causes the floating disk 12 to stop rotating when contacting a foreign surface. This prevents the floating disk 12 from causing the potential scraping or scratching damage that could result from the floating disk 12 rotating while in contact with the foreign object. Also, because the floating disk 12 and abrasion disk 16 rotate independently of each other, when the floating disk 12 and its non-marring friction material 26 comes into contact with the foreign object 54, the abrasion disk 16 will continue to rotate unimpeded.

The tool can also travel about the surface of the jutted foreign object (i.e., the shown backsplash 54), wherein the outer edge 28 of the floating disk 12 travels about the surface of the foreign object while the floating disk 12 rotates (this travel is shown by arrow 56 in FIG. 4C). The backsplash 54 is effectively a guide along which the floating disk of tool 10 rolls. This is also possible because the friction force between the non-marring friction material 26 and the foreign structure is greater than the friction force caused by the abrasion disk 16. This allows the abrasion disk 16 to continue to finish a surface and get very close to the foreign object, all while pushing the tool against the foreign object and moving it along the foreign object. For example, the abrasion surface 25 of the abrasion material 24 will be in contact with the finishing surface while the non-marring friction material 26 on the floating disk 12 is in contact with the foreign object. While both of these components maintain contact, the tool is moved parallel to the finishing surface and about the foreign object (this travel is shown by arrow 56). This allows the tool to reach corners or other surface areas that are difficult to finish without causing damage to the foreign object.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A damage prevention tool for use as an attachment to a power polisher, the tool comprising:

an abrasion disk comprising an axle that is adapted to be connected to the power polisher, the abrasion disk comprising a surface on which an abrasion material may be mounted;

a floating disk with an opening wherein the axle is disposed of in the opening, the floating disk further comprising a bearing structure constructed to allow the floating disk to rotate about the axle substantially independent of the abrasion disk.

2. The apparatus of claim 1, wherein the abrasion disk further comprises a raised rib.

3. The apparatus of claim 1, wherein the floating disk comprises a non-marring friction material.

4. The apparatus of claim 1, wherein the bearing structure is integrated into the floating disk.

5. The apparatus of claim 1, wherein the bearing structure is integrated into the abrasion disk.

6. The apparatus of claim 1, wherein the bearing structure is integrated into the axle.

7. The apparatus of claim 1, wherein the bearing structure is comprised of bearings selected from a group consisting of: ball bearings, needle bearings, or a plain sleeve bearings.

8. The apparatus of claim 1, wherein the bearing structure is comprised of rolling-element bearings.

9. The apparatus of claim 1, wherein the floating disk comprises an outer edge and a non-marring friction material disposed on the outer edge.

10. The apparatus of claim 9, wherein the circumference of the floating disk is greater than the circumference of the abrasion disk.

11. The apparatus of claim 1, wherein the bearing structure imparts a first friction force between the floating disk and the abrasion disk such that rotation of the axle during operation causes some rotation of floating disk.

12. The apparatus of claim 11, wherein the floating disk comprises a non-marring friction material adapted to come into contact with a foreign object during operation and the non-marring friction material imparts a second friction force between the floating disk and the foreign object, wherein the second friction force is greater than the first friction force such that the floating disk will stop rotating.

13. A method of finishing a surface, comprising:

providing a tool, wherein the tool comprises:

an abrasion disk comprising an axle that is adapted to be connected to the power polisher, the abrasion disk comprising a surface on which an abrasion material may be mounted, wherein an abrasion surface is a level surface that is an abrasive;

a floating disk with an opening wherein the axle is disposed of in the opening, the floating disk further comprising a bearing structure constructed to allow the floating disk to rotate about the axle substantially independent of the abrasion disk actuating the tool causing the abrasion disk to rotate;

placing the abrasion surface in contact with a finishing surface;

moving the tool substantially parallel to the finishing surface; and contacting the non-marring friction material to a foreign object that juts away from the finishing surface.

14. The method in claim 13, wherein actuating the abrasion disk causes the floating disk to rotate, the method further comprising:

stopping the rotation of the floating disk after the contacting step.

15. The method in claim 13, wherein the foreign object comprises a surface, the method further comprising:

traveling the tool about the surface of the jutted foreign object, wherein the outer circumference of the floating disk stays in substantial contact with the surface of the foreign object during the traveling step.

* * * * *